US009863625B2

(12) United States Patent
Cummings

(10) Patent No.: US 9,863,625 B2
(45) Date of Patent: Jan. 9, 2018

(54) MODULAR LUMINAIRE SYSTEM

(71) Applicant: Modulux Lighting, Inc., Pompano Beach, FL (US)

(72) Inventor: William J. Cummings, Pompano Beach, FL (US)

(73) Assignee: Modulux Lighting, Inc., Pompano Beach, FL (US)

( * ) Notice: Subject to any disclaimer, the term of this patent is extended or adjusted under 35 U.S.C. 154(b) by 223 days.

(21) Appl. No.: 14/894,503

(22) PCT Filed: Jun. 6, 2014

(86) PCT No.: PCT/US2014/041273

§ 371 (c)(1),
(2) Date: Nov. 28, 2015

(87) PCT Pub. No.: WO2014/197782

PCT Pub. Date: Dec. 11, 2014

(65) Prior Publication Data

US 2016/0123569 A1 May 5, 2016

Related U.S. Application Data

(60) Provisional application No. 61/832,293, filed on Jun. 7, 2013.

(51) Int. Cl.
*F21V 29/71* (2015.01)
*F21S 2/00* (2016.01)
(Continued)

(52) U.S. Cl.
CPC ..... *F21V 29/713* (2015.01); *F21K 9/20* (2016.08); *F21S 2/005* (2013.01); *F21V 23/005* (2013.01);
(Continued)

(58) Field of Classification Search
CPC ..... F21V 29/713; F21V 29/67; F21V 23/005; F21V 23/006; F21V 23/02; F21V 23/06;
(Continued)

(56) References Cited

U.S. PATENT DOCUMENTS 5,672,000 A * 9/1997 Lin ..... F21V 21/002 362/241
6,154,362 A * 11/2000 Takahashi ..... G09F 9/33 257/E25.028
(Continued)

FOREIGN PATENT DOCUMENTS

WO 2011056208 A2 5/2011

OTHER PUBLICATIONS

International Search Report and Written Opinion, PCT Patent Appln. No. PCT/US2014/041273, Rospatent, Nov. 20, 2014.

*Primary Examiner* — Bao Q Truong
(74) *Attorney, Agent, or Firm* — Nancy J. Flint, Esq.; Nancy J. Flint, Attorney At Law, P.A.

(57) ABSTRACT

A modular cube shaped light emitting diode (LED) luminaire that can be cascaded, or interconnected, to create a larger, higher power LED luminaire that produces more light than the modular LED luminaire is disclosed. Each modular LED luminaire comprises a housing, a heat sink, a power/control circuit board (PCB-A) and an LED circuit board (PCB-B). An optional fan and a metallic heat sink are also enclosed inside the modular LED luminaire housing/shell. The modular LED luminaire provides optical expansion across interconnected modular LED luminaires. The LEDs and heat sinks are easily removable for defect replacement, LED light replacement and upgrade, without uninstalling the entire luminaire. Secondary side processor control of the feedback regulator allows sensor, radio module, user inputs etc. to reside on the "safe" isolated (low voltage) secondary
(Continued)

side of the supply can then be used to safely make changes (an allowable UL approval) in the regulated output drive to the LEDs.

15 Claims, 6 Drawing Sheets

(51) Int. Cl.

| | |
|---|---|
| ***F21V 29/67*** | (2015.01) |
| ***F21V 23/00*** | (2015.01) |
| ***F21V 23/02*** | (2006.01) |
| ***F21V 23/06*** | (2006.01) |
| ***F21K 9/20*** | (2016.01) |
| *F21V 21/005* | (2006.01) |
| *F21V 29/76* | (2015.01) |
| *F21Y 105/10* | (2016.01) |
| *F21Y 115/10* | (2016.01) |

(52) U.S. Cl.
CPC ..... *F21V 23/006* (2013.01); *F21V 23/02* (2013.01); *F21V 23/06* (2013.01); *F21V 29/67* (2015.01); *F21V 21/005* (2013.01); *F21V 29/763* (2015.01); *F21Y 2105/10* (2016.08); *F21Y 2115/10* (2016.08)

(58) Field of Classification Search
CPC ..... F21V 29/763; F21V 21/005; F21V 17/00; F21V 17/10; F21V 17/16; F21V 17/164; F21V 19/00; F21V 21/088; F21K 9/20; F21S 2/005; F21Y 2105/10; F21Y 2115/10
See application file for complete search history.

(56) References Cited

U.S. PATENT DOCUMENTS

| | | | | |
|---|---|---|---|---|
| 7,350,937 | B2 * | 4/2008 | Yamamoto | F21S 2/005 362/249.01 |
| 7,355,562 | B2 * | 4/2008 | Schubert | G09F 9/33 345/1.3 |
| 7,832,897 | B2 * | 11/2010 | Ku | F21S 2/005 362/249.02 |
| 7,897,980 | B2 * | 3/2011 | Yuan | F21K 9/00 257/79 |
| 7,963,669 | B2 * | 6/2011 | Hockel | F21S 2/005 362/219 |
| 8,168,894 | B2 * | 5/2012 | Kuo | H05K 1/142 174/260 |
| 2001/0024368 | A1 | 9/2001 | Henrici et al. | |
| 2005/0007780 | A1 | 1/2005 | Feuerborn et al. | |

* cited by examiner

MODULAR LUMINAIRE SYSTEM

RELATED APPLICATION

This application claims the benefit of U.S. Provisional Patent Application Ser. No. 61/832293 titled MODULAR LED LUMINAIRE, filed on Jun. 7, 2013, the contents of which are herein incorporated by reference in its entirety.

FIELD OF THE INVENTION

The invention relates to a modular cube shaped light emitting diode (LED) luminaire that can be cascaded, or interconnected, to create a larger, higher power LED luminaire that produces more light than the modular LED luminaire. Each modular LED luminaire comprises a housing, a heat sink, a power/control circuit board (PCB-A) and an LED circuit board (PCB-B). An optional fan and a metallic heat sink are also enclosed inside the modular LED luminaire housing/shell. The modular LED luminaire provides optical expansion across interconnected modular LED luminaires. The LEDs and heat sinks are easily removable for defect replacement, LED light replacement and upgrade, without uninstalling the entire luminaire. Secondary side processor control of the feedback regulator allows sensor, radio module, user inputs etc. to reside on the "safe" isolated (low voltage) secondary side of the supply can then be used to safely make changes (an allowable UL approval) in the regulated output drive to the LEDs.

BACKGROUND OF THE INVENTION

Lights are typically placed in enclosures called luminaires to redirect and diffuse the light that is emitted. Light fixtures commonly have a fixture body and a light socket to hold the lamp and allow for its replacement. Technically the lamp is the light source, typically called the light bulb. Fixtures may also have a switch to control the light. Fixtures require an electrical connection to a power source; permanent lighting may be directly wired, and moveable lamps have a plug. Light fixtures may also have other features, such as reflectors for directing the light, an aperture (with or without a lens), an outer shell or housing for lamp alignment and protection, and an electrical ballast or power supply.

The following functions are performed by the luminaire; (1) connection of lamp electricity supply to lamp; (2) contain control circuitry for lamp; (3) heat dissipation from the lamp; (4) reflection and redirection of light to a target area; (5) protection of the lamp from the environment (e.g. outdoors); (6) provide a decorative appearance; and (7) light distribution of the lamp.

Most lighting fixtures emit heat as well as light that must be removed. Possible problems resulting from overheating include degradation of electronic components, degradation of materials used in construction, and fire. The lamp and luminaire form an integrated unit, and lamps that exceed the rating of the luminaire should not be used. Similarly, Also, the class of the lamps installed in the luminaire (e.g. compact fluorescent or incandescent) should not be changed unless the luminaire is rated for the new class type. Use of a non-rated class could lead to overheating of the luminaire.

Common sources of lighting today are by use of incandescent and fluorescent lamps (or bulbs). Incandescent lamps generate light by passing electric current through a resistive filament, thereby heating the filament to a very high temperature so that it glows and emits visible light over a broad range of wavelengths. Incandescent sources yield a "warm" yellow or white color quality depending on the filament operating temperature. Incandescent lamps emit 98% of the energy input as heat. A 100 W incandescent light bulb for 120 V operation emits about 1,180 lumens, for about 11.8 lumens/W; for 230 V bulbs the figures are 1340 lm and 13.4 lm/W, respectively. Incandescent lamps are relatively inexpensive to make. The typical lifespan of an AC incandescent lamp is 750 to 1,000 hours. They work well with dimmers. Most older light fixtures are designed for the size and shape of these traditional bulbs.

Fluorescent lamps work by passing electricity through mercury vapor, which in turn emits ultraviolet light. The ultraviolet light is then absorbed by a phosphor coating inside the lamp, causing it to glow, or fluoresce. Conventional linear fluorescent lamps have life spans around 6,000 to 30,000 hours. The life expectancy depends on the number of on/off cycles, and is lower if the light is cycled often. The ballast-lamp combined system efficacy for then current linear fluorescent systems in 1998 ranged from 80 to 90 lm/W. For comparison, general household LED bulbs available in 2011 emit 64 lumens/W, with the best LED bulbs coming in at about 140 lumens/W. Because fluorescent bulbs contain toxic mercury, they are potentially hazardous and difficult to dispose.

Lighting can also be provided by light-emitting diodes, or LEDs. LEDs can be integrated into a variety of products, such as flashlights, light bulbs, and integrated light fixtures. LEDs are part of a family of lighting technologies called Solid-State lighting.

LED lighting products produce light very efficiently. LEDs are small light sources that become illuminated by the movement of electrons. LED lighting starts with a tiny chip (commonly about one square millimeter) comprised of layers of semi-conducting material. LED packages may contain just one chip or multiple chips, mounted on heat-conducting material called a heat sink and usually enclosed in a primary lens. The resulting device, typically several to a side, can be used separately or in arrays.

LEDs are highly directional light sources, whereas an incandescent or fluorescent bulb emits light—and heat—in all directions, resulting in significant energy losses. For direct lighting applications LED lighting uses both light and energy more efficiently despite higher initial costs.

The ability to use an LED to direct light allows for illumination of a flat defined target area requiring a lower luminous output compared to more traditional light sources, such as fluorescent or incandescent which would need reflectors or lenses to do the same. In comparison, the benefits of LED lighting are much smaller for illuminating a 360° orbit.

Like traditional light sources, the LED produces heat. Ultimately only about 30-40% of the input energy is turned into light, with the remaining 60-70% of the energy converted to thermal energy mainly by the way of non-radiative and combinative generated lattice vibration. Operating an LED at high temperatures lowers its efficiency and also the usable life of the LED. Thermal management is a key issue for LED products so reduction of heat generation improves luminous efficacy of LED.

LEDs are commonly thermally connected to a heat sink. For best performance this heat sink is thermally contiguous with the body of the luminaire and provides not only conductive cooling to the LEDs, but also provides convective cooling due to air circulation around the heat sink or luminaire body. Passive heat sinks are typically metal or other thermally conductive material attached to a component from which heat is transferred to the heat sink. The heat then radiates from the heat sink into the surrounding air. In many cases, passive heat sinks provide sufficient cooling. However, for heat sinks to be effective, particularly in high heat environments and/or high power applications, they should have large amounts of surface area from which to radiate the heat. The more surface area, the more heat that can be transferred to the surrounding air. Accordingly, some heat sinks have numerous fins, bends, or folds to increase surface area.

LEDs are diodes, which are electronic devices that allow current flow in one direction and block current flow in the reverse direction. LEDs thus have 2 electrodes, one positive (the cathode) and one negative (the anode). LEDs must be wired with the proper polarity or they will not illuminate, or could be damaged or destroyed. LEDs have some intrinsic resistance limiting current flow through them. Incandescent lamp filaments for example have a positive temperature coefficient of resistance; when they get hotter, their resistance rises. LEDs have negative temperature coefficient and the possibility of a thermal runaway. Proper heat sinking therefore is an important consideration for an LED.

A printed circuit board, or PCB, is used to mechanically support and electrically connect electronic components using conductive pathways, tracks or signal traces etched from copper sheets laminated onto a non-conductive substrate. A PCB populated with electronic components is called a printed circuit assembly (PCA), printed circuit board assembly. In informal use the term "PCB" is used both for bare and assembled boards. After the PCB is completed, electronic components must be attached to form a functional PCA.

Modular lighting systems offer a number of advantages in that the components simply plug together, making installation quick and easy, and yielding time and labor savings. The flexibility of modular lighting systems allows lighting fixtures to be easily relocated by unplugging connections, moving the fixtures, and plugging the cables back in again. The downside to modular lighting systems is principally cost. Individual modules invariably introduce extra materials such as plastic or metal module housings, and complex electrical and mechanical connectors. Moreover the cost of separately assembling the modules is an extra cost. A module may also restrict design elements in a luminaire and therefore aesthetics.

U.S. Pat. No. 5,672,000 to Lin titled Decorative Lamp Strip discloses, "[a]n improved decorative lamp strip comprising a three-strand flat electric wire, some main sets, some fixing plates, some sets of series connected conductive piece, some sets of a first parallel connected conductive piece, some sets of a second parallel connected conductive piece, some lamp seats and some bulbs with tungsten filament in general or some LED bulbs, wherein the flat electric wire comprises a middle strand series connected conductor and an upper and a lower strand parallel connected conductors, a plurality of holes are punched on the electric wire body, and each punched hole breaks the middle strand conductor, each main seat is installed in the position of each punched hole on the flat electric wire to engage with a fixing plate, and to let any one set of conductive piece installed on the main seat thrust into the middle, upper or lower strand conductor of the flat electric wire so as to combine a decorative lamp strip."

U.S. Pat. No. 6,154,362 to Takashi et al. titled Display Apparatus discloses, "[a] display apparatus provided with display cells wherein LEDs are arranged in dot-like array within a case and molded by a mold portion within the case, and a unit portion accommodating therein a cell substrate on which the display cells are mounted. Further, there are provided ventilation holes formed so as to penetrate the display cells at prescribed positions in a direction from rear to front, a fan which is provided in an upper part of a rear surface of the unit portion can send cooling air into the unit portion and an opening portion formed at a bottom surface of the unit portion, thereby making it possible to discharge the cooling air sent by the fan to outside from the ventilation holes through the opening portion. Further, a penthouse unit is provided in front of the display cells and the cooling air discharged from the ventilation holes is caused to be returned to a side of the LEDs."

U.S. Pat. No. 7,355,562 to Schubert et al. titled Electronic Interlocking Graphics Panel Formed of Modular Interconnecting Parts discloses a modular display panel is formed of a segmented symmetrical graphics panel having display pixels. The panel's interlock in for directions allows forming larger electronic graphics panel. The preferred shape of the panel is square, defining a perimeter with for edge surfaces. Each of those edge surfaces includes an electrical connection thereon. A frame assembly forms the outer portion of the panel, thereby allowing providing of signals and power to the units." Further, the patent discloses "a new kind of electronic graphics panel formed of interlocking modules which can be interlocked together in order to form a graphics panel of any desired size. One aspect describes a light emitting diode ('LED') based modular graphics panel formed of interlocking modules that can be connected into any of a number of different arrangements. A computer may be used to control the display on the graphics panel. In an embodiment, the graphics panel is framed by a frame assembly which may include electronics therein, the electronics may include a memory that stores information to form a static display for an electronic sign or other application. Another feature of this system is the way that the modular blocks inter-connect which prevents upside down connection of the different modular blocks."

U.S. Pat. No. 7,897,980 to Yuan et al. titled Expandable LED Array Interconnect discloses a "light emitting device that can function as an array element in an expandable array of such devices. The light emitting device comprises a substrate that has a top surface and a plurality of edges. Input and output terminals are mounted to the top surface of the substrate. Both terminals comprise a plurality of contact pads disposed proximate to the edges of the substrate, allowing for easy access to both terminals from multiple edges of the substrate. A light emitting device can function as an array element in an expandable array of such devices. The light emitting device comprises a substrate that has a top surface and a plurality of edges. Input and output terminals are mounted to the top surface of the substrate. Both terminals comprise a plurality of contact pads disposed proximate to the edges of the substrate, allowing for easy access to both terminals from multiple edges of the substrate. A lighting element is mounted to the top surface of the substrate. The lighting element is connected between the input and output terminals. The contact pads provide multiple access points to the terminals which allow for greater flexibility in design when the devices are used as array elements in an expandable array."

U.S. Pat. No. 7,963,669 to Hockel et al. titled Modular Lighting System and Lighting Arrangement discloses "[a] modular lighting system having a plurality of light modules, which each have a plurality of light modules accommodating at least one light-emitting diode module. The light modules have at least two mounting clearances, which run substantially parallel, and a mounting rod passes through each mounting clearance for mechanical fixing and electrical contact-making purposes. The mounting clearances are formed on the luminaire body. A lighting arrangement of such lighting systems is also disclosed."

U.S. Pat. No. 8,168,894 to Kuo titled Light Emitting Diode (LED) Circuit Board with Multi-Directional Electrical Connection discloses a "light emitting diode (LED) circuit board with a multi-directional electrical connection. The board includes a board body with a surface and an assembly plane as well as four sides and corresponding corners, and a plurality of positive and negative electric contacts, separately arranged onto the surface of the board body nearby four sides, and also arranged at intervals." Additionally, "the LED circuit board with multi-directional electrical connection allows the board body to be provided with positive and negative electric contacts. It is possible to simplify the circuit of the LED circuit board of the present invention, helping to facilitate multi-directional electrical connection and expansion, and improve significantly the paving efficiency of LED circuit board with better practicability and industrial benefits.: Further, "[b]ased upon the branching sign, the installers may find it easier to identify if the positive and negative electric contacts at various sides of the board body are power input or output side, and then decide the arrangement direction of the board body. Based upon the structure of a notched flange preset at two connected sides of the board body of the LED circuit board, it is easy to break off the sides and level the fracture surface."

SUMMARY OF THE INVENTION

The invention relates to a modular LED luminaire that can be cascaded, or interconnected, to create a larger, higher power expanded luminaire that produces more light than the modular LED luminaire. The modular LED luminaire of the invention comprises a power/control circuit board (PCB-A) and an LED circuit board (PCB-B) disposed within the inner cavity of a housing. The modular LED luminaire further comprises a plurality of LEDs residing on PCB-B, which is in thermal connection with a heat sink and in electrical communication with the power/control circuit board PCB-A. The modular LED luminaire of the invention further provides for electrical interconnection between the PCB-As of any two adjacent modular LED luminaires. The modular LED luminaire of the invention provides for optical expansion using equivalent lens spacing (contiguous/equal spacing in x and y directions) resulting from LED luminaire geometry and positioning of LEDs within each modular LED luminaire. When configured as such the invention provides for optical expansion resulting from equivalent lens spacing across multiple modular LED luminaires. The modular LED luminaire of the invention further comprises a method for thermal convection by way of plates attached to the perimeter of the heat sink which permit heat spreading and dissipation away from the heat sink. The modular LED luminaire of the invention further comprises a method for mechanical attachment whereby adjacent modular LED luminaires may be reasonably attached by way of 2 or more appendages of each modular LED luminaire. Additionally, the bottom surfaces of multiple modular LED luminaires are held together mechanically by a perimeter mounted plate which surrounds the plurality of modular LED luminaire heat sinks. A metallic heat sink and an optional fan are also enclosed inside each modular LED luminaire housing. In one embodiment, the modular LED luminaire is cube shaped.

BRIEF DESCRIPTION OF THE DRAWINGS

The invention will be described with reference to the accompanying drawings, in which like elements are referenced with like numerals.

DETAILED DESCRIPTION OF THE INVENTION

Figure 2:
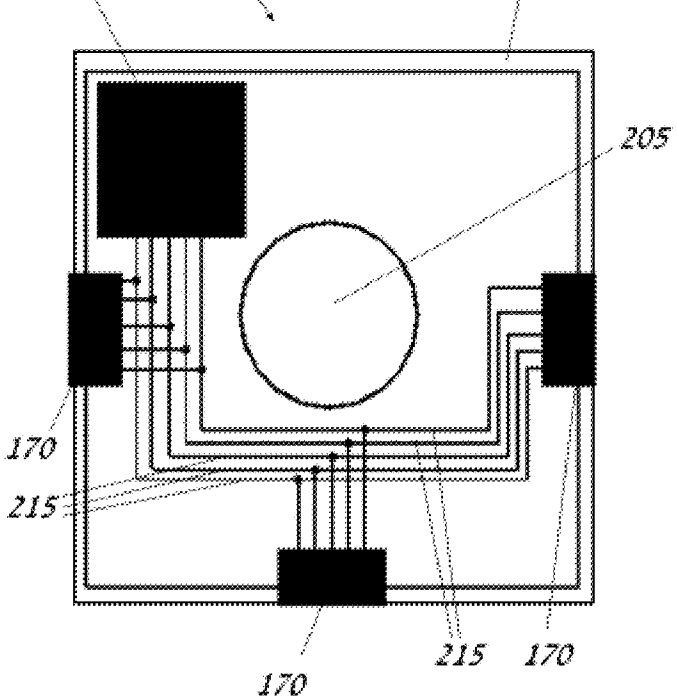
FIG. 2 depicts a top view of a PCB suitable for use as PCB-A in one embodiment of the invention.

The invention relates to a modular cube shaped light emitting diode (LED) luminaire that can be cascaded, or interconnected, to create a larger, higher power LED luminaire that produces more light than the modular LED luminaire. Each modular LED luminaire of the invention comprises a printed circuit board (PCB-A) and an LED circuit board (PCB-B) disposed within the inner cavity of a housing. The modular LED luminaire further comprises a plurality of LEDs residing on PCB-B, which is in thermal connection with a heat sink and in electrical communication with the power/control circuit board PCB-A through a plurality of vertical insulated wires that pass through the heat sink. Various optical arrays can reside on top of the LEDs to concentrate and direct generated light toward a target area or surface. The modular LED luminaire of the invention provides for electrical interconnection between the PCB-As of any two adjacent modular LED luminaires and subsequently the microprocessors disposed on PCB-As on adjacent modular LED luminaires. The modular LED luminaire of the invention provides for optical expansion using equivalent spacing resulting from modular LED luminaire geometry and positioning of LEDs on equal spacing within each modular LED luminaire (meaning that spacing from LED to LED on any modular LED luminaire AND between adjacent modular LED luminaires is contiguous/equal in both the x and y directions). The modular LED luminaire of the invention further comprises a method for thermal convection by way of plates attached to the perimeter of the heat sink which permit heat spreading and dissipation away from the heat sink. The modular LED luminaire of the invention further comprises a method for mechanical attachment whereby adjacent modular LED luminaires may be attached by way of 2 or more appendages of the modular LED luminaire housings. Additionally, the bottom surfaces of multiple modular LED luminaire housings are held together mechanically by a perimeter mounted plate which surrounds the plurality of modular LED luminaire heat sinks. A heat sink and optional fan are also enclosed inside the modular LED luminaire housing. In one embodiment, the modular LED luminaire is cube shaped.

The following description is provided of one embodiment of the invention. The principles are not to be limited to this embodiment but rather a person having ordinary skill in the art can apply these principles to other embodiments within the scope of the invention.

In one embodiment, a first PCB (PCB-A) resides in a modular LED luminaire housing substantially parallel to a top surface of a heat sink, where a second PCB (PCB-B), is disposed on the opposite bottom surface of the heat sink, substantially at the bottom of the modular LED luminaire housing. PCB-A comprises a complete universal (85-277 Volt) AC to DC power supply and a primary side regulator circuit. A microprocessing integrated circuit (IC) which may be a CPU, CPU/DSP, DSP or any other processor now known or later developed further resides on PCB-A. Any other feature that can reside on a PCB may be further included on PCB-A, such as a clock or a dimmer circuit, as is well known to those skilled in the art.

PCB-A connects to PCB-B via a plurality of vertical insulated wires that pass through the heat sink. PCB-B comprises a plurality of LEDs disposed thereon. A variety of different optical arrays can reside on top of the LEDs to concentrate and direct generated light toward a target area or surface.

In one embodiment, the modular LED luminaire is approximately a 4 inch cube shape. A plurality of modular LED luminaires can be interconnected to form an expanded LED lighting module in a 2 dimensional plane. In addition to physically interconnecting the modular LED luminaires, electrical signals can also be interconnected between adjacent modular LED luminaires.

The modular LED luminaire housing in one embodiment comprises a plastic molded enclosure configured to house in its interior at least PCB-A, a heat sink and PCB-B. The size and geometry of the modular LED luminaire housing can be determined by a person skilled in the art and is not intended to limit the invention in any manner.

Electrical Interconnect Method between Adjacent Modular LED Luminaires and Corresponding Internal PCB-A Processors.

PCB-A comprises a plurality of PCB traces routed around the perimeter of the PCB-A. A processor is disposed on PCB-A which has bidirectional connectivity to the set of perimeter tracks. Unidirectional power/ground signals are connected to additional perimeter tracks. PCB-A comprises a top surface, a bottom surface parallel to the top surface, a height defined by the distance between the top surface and the bottom surface, and four (4) side edges of substantially equal length. A multi-conductor female connector is disposed substantially at the center of the side edge of each PCB-A. The multi-conductor female connector comprises a plurality of electrical terminals which connect to the PCB perimeter traces and a plurality of recessed holes, with each recessed hole providing access to a unique electrical terminal The number of recessed holes in the multi-conductor female connector having electrical terminals can vary according to the design of a particular modular LED luminaire and any multi-conductor female connector can be used in the invention. When multiple modular LED luminaires are to be interconnected, a double sided male pin connector having the same number of pins as the number of recessed holes in each female conductor is placed between two adjacent female connectors. The center signal between the male and female connectors from modular LED luminaire to modular LED luminaire is directly and "properly" connected. However, given identical modular LED luminaires, the off center signals from one modular LED luminaire will not directly connect to the correct matching signal on the second modular LED luminaire. For example, consider a female connector with center signal A, signal B right and signal B' left. When connecting a second modular LED luminaire, a planar body rotation results in a match between signals B, A, B' on modular LED luminaire 1 with signals B', A, B on modular LED luminaire 2.

To connect off center signals in the modular LED luminaires of the invention, signals B and B' are electrically connected through PCB traces on PCB-A within each modular LED luminaire. This allows for correct connections, specifically signal A and signal B-B'. By means of electrically connecting signals B and B' on PCB-A, effectively only 2 distinct electrical paths result from three traces since there is a duplication of electrical connectivity on traces B and B'. Additional signals can be properly routed from modular LED luminaire to modular LED luminaire by using additional paired tracks in the same fashion.

When interconnected, power supplied to any one modular LED luminaire can supply all interconnected modular LED luminaires.

Optical Expansion of Modular LED Luminaires.

On each modular LED luminaire, the LEDs have equal X and Y directional spacing on PCB-B. Further, the spacing between adjacent LEDs on any single modular LED luminaire is equivalent to the spacing between adjacent LEDs on adjacent interconnected LED luminaires. Accordingly LED spacing across adjacent modular LED luminaires matches the spacing between LEDs residing on PCB-B of each modular LED luminaire. This configuration provides the benefit of continuous equally spaced LEDs both on the face of PCB-B of a given modular LED luminaire AND equal LED spacing across the boundary between modular LED luminaires within a plurality of interconnected modular LED luminaires. Equal spacing in both the X and the Y planar directions across the entire plurality of modular LED luminaires results in a desirable illumination pattern at the distant target surface.

Thermal Convection of Modular LED Luminaires.

Each modular LED luminaire may optionally have a perimeter mounted metallic plate attached to the perimeter of the heat sink which sufficiently passes through two or more sides of each modular LED luminaire. The perimeter mounted metallic plate allows heat to spread and dissipate away from the heat sink. Each configuration comprised of a plurality of modular LED luminaires requires a specifically different plate mounted around the perimeter of the plurality of modular LED luminaires. Additionally if the entire modular LED luminaire assembly is housed within a thermally conductive enclosure/fixture, the heat will further dissipate out to the enclosure/fixture by attaching the perimeter mounted metallic plate to the fixture.

From a side view, each perimeter mounted metallic plate may have an aesthetic appealing finish and/or shape. For example, the side edge of the perimeter mounted metallic plate may have a brushed or polished finish, or may have a curved or straight design according to the design. The design and aesthetic finish of the perimeter mounted metallic plate can be determined buy any person skilled in the art and does not limit the invention in any manner.

Light Engine Removal and Replacement.

The heat sink and PCB-B together make up a "light engine" which can easily be removed for defect replacement, LED light replacement or upgrade. Vertical insulated wires pass through drill holes in the heat sink which provide electrical conductivity between PCB-A and PCB-B for powering and sensing the temperature of the LEDs residing on PCB-B. Drill hole diameters in the heat sink are sufficiently larger than the diameter of the insulating layer of the wires.

Each wire is soldered to a PCB-B conductive via and passes through PCB-B, through the heat sink (without electrically contacting the heat sink), and subsequently pressure fits into a connector residing on PCB-A. The connecter releasably engages the insulated wire around its circumference with suitable force to maintain sufficient electrical contact. Thus the light engine can be released from the modular LED luminaire housing of a given modular LED luminaire for repair or replacement, and then re-inserted without separating the plurality of LED module housings from each other, or from AC power when the entire luminaire is installed. Additionally, the entire modular LED luminaire can remain installed and AC power connections do not have to be removed during upgrade or repair of the fixture.

Mechanical Attachment of Adjacent Modular LED Luminaires.

Adjacent modular LED luminaires can be interconnected together to form a larger LED luminaire by removable attachment of inter-module snap clips and inter-module posts. The modular LED luminaire housing of each modular LED luminaire comprises a plurality of attachment means configured for attachment of inter-module snap clips to modular to the LED luminaire housing. In one embodiment, each inter-module snap clip comprises a flexible open ring terminating on each end with tabs disposed at opposing angles at the each end of the open ring to form a V-shaped engagement unit. In one embodiment, one end of each inter-module snap clip comprises a snap clip base and the attachment means on the modular LED luminaire housing comprises a slot, where the snap clip base of the inter-module snap clip is removably insertable into the slot of the modular LED luminaire housing to attach the inter-module snap clip to the modular LED luminaire. The inter-module posts have a larger width at the end proximal to the edge of the modular LED luminaire than the opening in the ring of the inter-module snap clip. The inter-module posts further comprise a recess disposed on opposite sides.

To interconnect modular LED luminaires, inter-module snap clips are inserted into attachment means along the sides of the modular LED luminaire housings of the modular LED luminaires to be interconnected. The inserted inter-module snap clips extend horizontally from the sides of the modular LED luminaire housings and the open section of each ring is aligned with the corresponding inter-module post of an adjacent modular LED luminaire. Tension is created in the ring as the inter-module snap clip is inserted over the inter-module post until the V-shaped engagement units formed by the tabs at each end of the rings of the inter-module snap clip engage with the recesses in the inter-module post. The engagement between the inter-module post and the inter-module snap clip holds the adjacent modular LED luminaires together. While the adjacent modular LED luminaires may be detached from each other by exerting sufficient force spreading apart the opening of the ring such that the engagement units on each end of the ring slips out of the recesses of the inter-module posts, such force is not encountered in ordinary operation and use of the modular LED luminaires and so interconnected modular LED luminaires will generally remain connected unless and until they are intentionally detached from each other.

Cooling of Modular LED Luminaires.

Construction of the modular LED luminaire and positioning of an internal fan within the cavity of the modular LED luminaire housing facilitates air circulated cooling of critical electrical components residing on the underside of PCB-A.

Additionally, the modular LED luminaire of the invention comprises features that can be applied to other applications and systems separate and apart from the modular LED luminaire.

Secondary Side Processor Control of Feedback Regulator.

In one embodiment, PCB-A comprises an analog voltage/current regulation circuit using common primary side current/voltage feedback loop regulation. Voltage sensed across an auxiliary primary side transformer winding controls the LED drive current per common practice. In the invention, a secondary side processor based signal additionally allows "intelligent" control of the LED current regulation. The "intelligent" regulation signal is generated by the processor on the secondary (low voltage-isolated) side of the internal power supply. A pulse width modulated (PWM) signal generated by the processor is connected to an isolation device (such as an opto-coupler). The isolation device transfers the primary side PWM signal across the isolation barrier to the primary side of PCB-A. The primary side PWM signal is then sent through a low pass filter to convert the PWM pulse train into an analog equivalent signal. The converted analog signal becomes an additional input to the primary side regulation circuit. This "intelligent" signal provides an additional means to control the LED drive current.

A lower voltage secondary side processor driven control output selectively increases or decreases the regulated current driving a plurality of LEDs. Selective increase/decrease in LED power is controlled by processor software/firmware. In the invention, the processor initiates LED power changes by increasing or decreasing a digital output signal duty cycle, crossing the isolation barrier with an opto coupler (or RF coupler device) and converting the isolated primary side PWM pulse train with a low pass filter. The analog low pass filter output is then fed to the regulator circuit which in turn modifies the regulator output current drive level. Sensor, radio module, user inputs etc. which reside on the "safe" isolated (low voltage) secondary side of the supply can then be used to safely make changes (an allowable UL approval) in the regulated output drive to the LEDs.

Integral Digital Signal Processing Method for Bidirectional Triode Thyristor (Triac) Dimming.

Incoming AC line voltage is resistor divided down to a high and low voltage. The low voltage level becomes a small signal processor/DSP input. The DSP signal is integrated over a time interval. The shape of the integrated result is digitally processed to determine nominal AC line voltage (nominal 120 VAC, nominal 240 VAC, or nominal 277 VAC). The magnitude of the integrated result is used to determine dimming percentage of the chopped AC line input. When the dimming percentage is determined, the DSP/CPU appropriately increases or decreases the fore-mentioned PWM duty cycle which is sent back over the isolation barrier and subsequently filtered on the primary side becoming an equivalent analog signal. This analog signal becomes an additional input into the primary side regulation circuit causing regulated drive current to be increased or decreased.

At the AC input, an active or passive bleeder circuit draws current at low voltage levels to ensure that the Triac does not misfire. The amount of current is dependent on the type of dimmer used. The processor/DSP is programmed to initiate the proper bleeder current draw as minimally required by the type of Triac dimmer being used.

Figure 1:
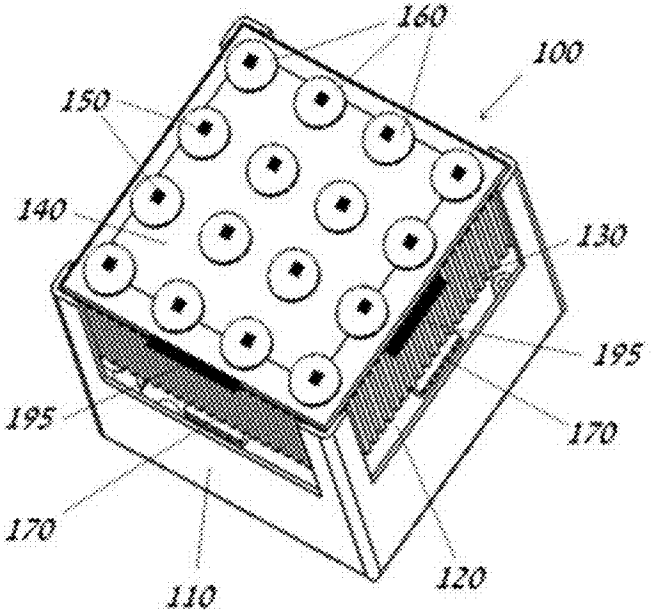
FIG. 1 depicts a side perspective view of a modular LED luminaire according to one embodiment of the invention.

Turning to the figures, FIG. 1 depicts a side perspective view of a modular LED luminaire 100 according to one embodiment of the invention. Modular LED luminaire 100 comprises modular LED luminaire housing 110; PCB-A 120; heat sink 130; PCB-B 140; a plurality of LEDs $\mathbf{150}_{1-i}$; and optical array 160. Modular LED luminaire housing 110 can be injection molded as a single piece. Heat sink 130 may comprise a plurality of perimeter mounted metallic plate slots $\mathbf{195}_{1-i}$ for the attachment of perimeter mounted metallic plates (not shown).

FIG. 2 depicts a top view of a PCB suitable for use as PCB-A 120 according to one embodiment of the invention. PCB-A 120 comprises a plurality of multi-conductor female connectors $\mathbf{1701}_{1-i}$; a cooling fan cavity 205; a plurality of PCB tracks $\mathbf{215}_{A-i}$; and a processor 225. PCB tracks $\mathbf{215}_{A-i}$; are typically designated with the center track designed PCB track $\mathbf{215}_{A}$, with the tracks adjacent to PCB track $\mathbf{215}_{A}$ designated PCB track $\mathbf{215}_{B}$ and PCB track $\mathbf{215}_{B'}$; the track adjacent to PCB track $\mathbf{215}_{B}$ designated PCB track $\mathbf{215}_{C}$ and the track adjacent to PCB track $\mathbf{215}_{B'}$ designated PCB track 215*C*; etc. The embodiment shown in FIG. 2 has five (5) tracks designated PCB track $\mathbf{215}_{A}$; PCB track $\mathbf{215}_{C}$; PCB track $\mathbf{215}_{B'}$; PCB track $\mathbf{215}_{C}$; and PCB track $\mathbf{215}_{C''}$. However, the number of PCB tracks $\mathbf{215}_{A-i}$ disposed on PCB-A 120 can vary as can be determined by those having ordinary skill in the art and the invention is not limited in any manner by the embodiment shown in FIG. 2. The embodiment of FIG. 2 depicts three (3) multi-conductor female connectors $\mathbf{170}_{1-i}$ disposed in the center of three (3) of the outer edges of PCB-A 120, as it has been determined that any 2-dimensional geometry of interconnected modular LED luminaires 100 can be electrically interconnected if PCB-A 120 of every modular LED luminaires 100 has three (3) such connectors. However, PCB-A 120 may have any number of multi-conductor female connectors $\mathbf{170}_{1-i}$ positioned on PCB-A 120 as determined by a person having ordinary skill in the art and the invention is not limited in any manner by the embodiment shown in FIG. 2. PCB-A 120 is positioned within the inner cavity of modular LED luminaire housing 110.

Figure 3:
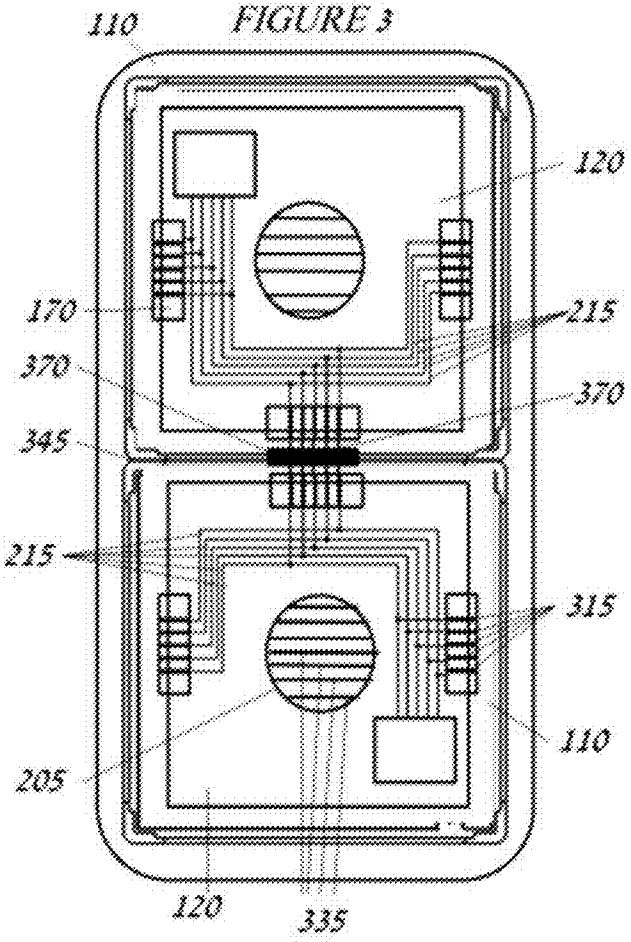
FIG. 3 depicts a top view of two (2) interconnected PCB-As according to one embodiment of the invention.

FIG. 3 depicts a top view of two (2) interconnected PCB-As 120 according to one embodiment of the invention. Each PCB-A 120 comprises a multi-conductor female connector $\mathbf{170}_{1}$ disposed in the center of one side, where each multi-conductor female connector $\mathbf{170}_{1}$ comprises a plurality of recessed holes with electrical terminals $\mathbf{315}_{A-i}$ which correspond and provide electrical connectivity to PCB tracks $\mathbf{215}_{A-i}$. Double sided male pin connector $\mathbf{370}_{1}$ having the same number of pins $\mathbf{325}_{A-i}$ which correspond to the number of recessed holes with electrical terminals $\mathbf{315}_{A-i}$ that in turn correspond and provide electrical connectivity to PCB tracks $\mathbf{215}_{A-i}$.

Other features shown in FIG. 3 include cooling fan cavity 205; cooling fan filter grid 335; and interconnection feature 345 which will be described in more detail in FIG. 10.

Figure 4:
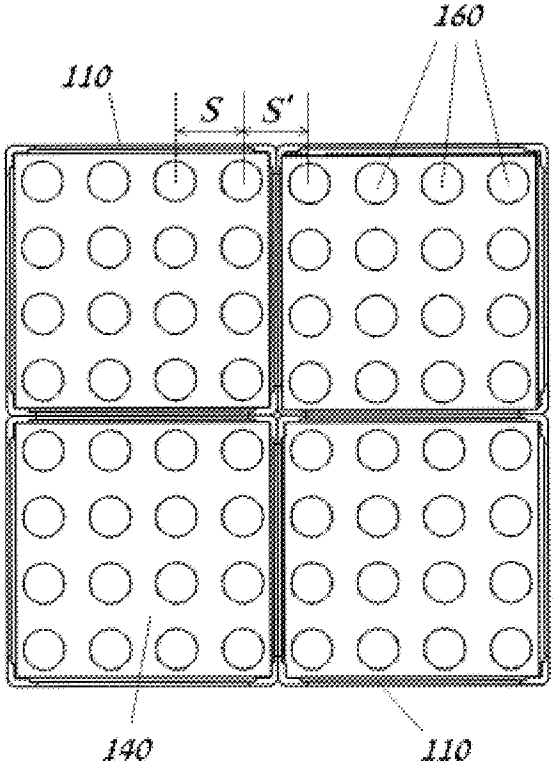
FIG. 4 depicts a bottom view of three (3) interconnected modular LED luminaires depicting the optical expansion feature according to one embodiment of the invention.

FIG. 4 depicts a bottom view of four (4) interconnected modular LED luminaires 100 depicting the optical expansion feature according to one embodiment of the invention. LEDs $\mathbf{150}_{1-i}$ residing on PCB-B 140 of each modular LED luminaire 110 have equal directional spacing S on PCB-B. Further, the spacing between adjacent LEDs $\mathbf{150}_{1-i}$ on any single modular LED luminaire 110 is equivalent to the spacing S' between adjacent LEDs $\mathbf{150}_{1-i}$ on adjacent interconnected LED luminaires 100, where S=S'. Accordingly spacing between LEDs $\mathbf{150}_{1-i}$ across adjacent modular LED luminaires 100 matches the spacing between LEDs $\mathbf{150}_{1-i}$ residing on PCB-B 140 of each modular LED luminaire 100. This configuration provides the benefit of continuous equally spaced LEDs $\mathbf{150}_{1-i}$ both on the face of PCB-B 140 of a given modular LED luminaire 110 AND continuous equally spaced LEDs $\mathbf{150}_{1-i}$ across interconnected modular LED luminaires 100 within a plurality of interconnected modular LED luminaires 100.

Figure 5:
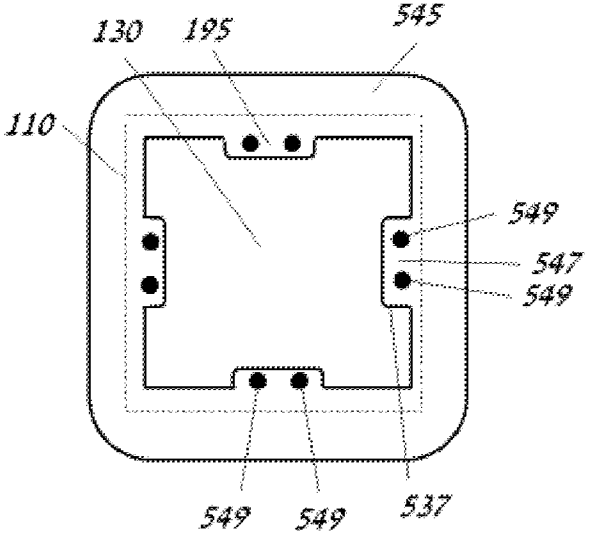
FIG. 5 depicts a bottom view of a perimeter mounted metallic plate attached to the perimeter of the heat sink of a modular LED luminaire according to one embodiment of the invention.

FIG. 5 depicts a bottom view of a perimeter mounted metallic plate 545 attached to the perimeter of the heat sink 130 of a modular LED luminaire 100 according to one embodiment of the invention. The perimeter mounted metallic plate 545 allows heat to spread and dissipate away from the heat sink 130. Each heat sink 130 comprises a plurality of notches $\mathbf{537}_{1-i}$ around its perimeter which engages with matching tabs $\mathbf{547}_{1-i}$ in perimeter mounted metallic plate 545 which provides secure attachment of perimeter mounted metallic plate 545 and heat sink 130. Heat sink 130 further comprises a plurality of screw holes (not shown) and perimeter mounted metallic plate 545 comprises a plurality of matching screw holes $\mathbf{549}_{1-i}$ for securing perimeter mounted metallic plate 545 to heat sink 130 by means of screws. Other attachment mechanisms can be used to attach perimeter mounted metallic plate 545 to heat sink 130 as is known to those having ordinary skill in the art and the invention is not intended to be limited by this embodiment.

Figure 6A:
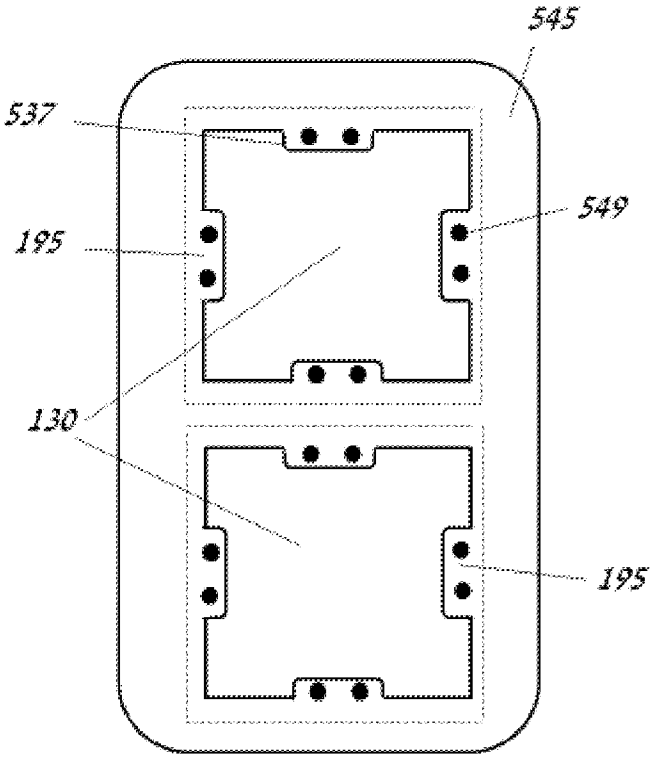
FIG. 6A depicts a bottom view of a perimeter mounted metallic plates attached to the perimeters of the heat sinks of three (3) interconnected LED luminaires according to one embodiment of the invention.

FIG. 6A depicts a bottom view of a perimeter mounted metallic plate 545 attached to the perimeters of the heat sinks 130 of two (2) interconnected modular LED luminaires 100 according to one embodiment of the invention. Each configuration of interconnected modular LED luminaires 100 requires a specifically different configured perimeter mounted metallic plate 545 mounted around the perimeter of the plurality of modular LED luminaires 100. Additionally if the entire interconnected LED luminaire assembly is housed within a thermally conductive enclosure/fixture (not shown), the heat will further dissipate out to the enclosure/fixture by attaching the perimeter mounted metallic plate 545 to the fixture.

Figure 6B:
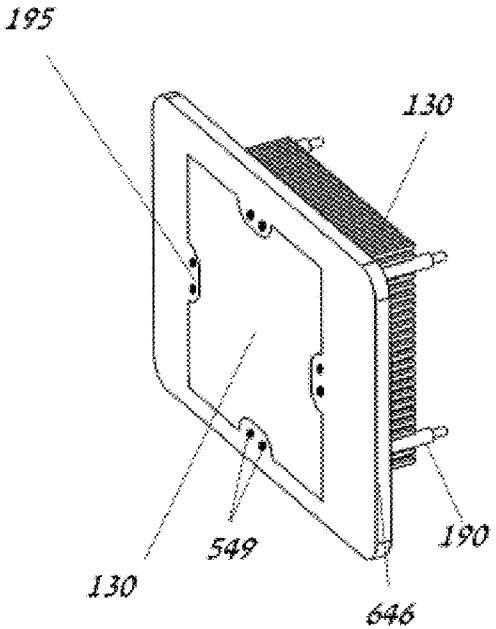
FIG. 6B depicts a front perspective view of a perimeter mounted metallic plate attached to the perimeter of a heat sink of a modular LED luminaire.

FIG. 6B depicts a front perspective view of a perimeter mounted metallic plate 545 attached to the perimeter of a heat sink 130 of a modular LED luminaire. From the side, the perimeter mounted metallic plate 545 may have an aesthetic appealing finish and/or shape 646. For example, the side edge 646 of the perimeter mounted metallic plate 545 may have a brushed or polished finish, or may have a curved or straight design according to the design. The design and aesthetic finish of the perimeter mounted metallic plate 545 can be determined by any person skilled in the art and does not limit the invention in any manner.

Figure 7:
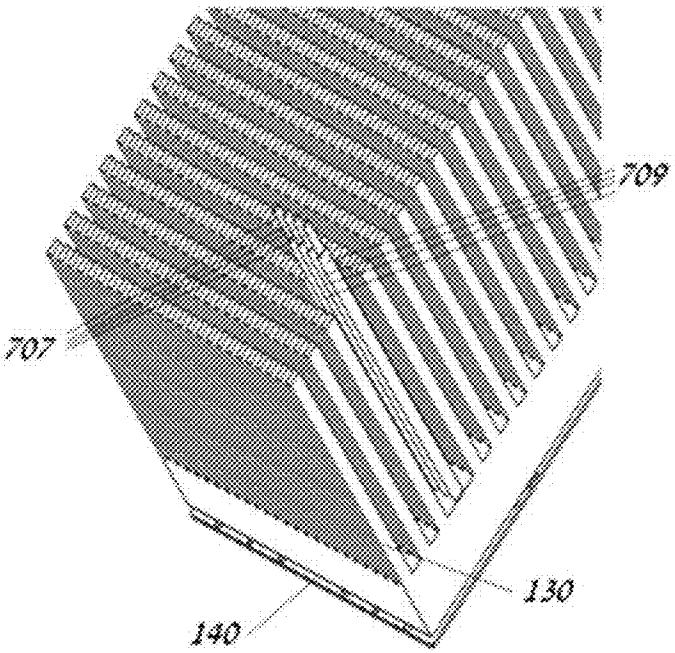
FIG. 7 depicts a side perspective view of a light engine according to one embodiment of the invention.

FIG. 7 depicts a side perspective view of a light engine 700 according to one embodiment of the invention. Heat sink 130 and PCB-B 140 together make up a "light engine" 700 which can easily be removed for defect replacement, LED light replacement or upgrade. Vertical insulated wires 707 pass through drill holes in the heat sink 130 which provide electrical conductivity between PCB-A 120 and PCB-B 140 for powering and sensing the temperature of the LEDs (not shown) residing on PCB-B 140. Drill hole diameters in heat sink 130 are sufficiently larger than the diameter of the insulating layer 709 of the insulated wires 707.

Figure 8:
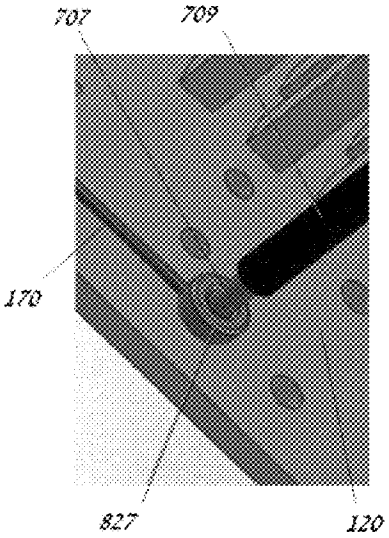
FIG. 8 depicts a side perspective view of an insulated wire connected to PCB-A via a compression fitting according to one embodiment of the invention.

FIG. 8 depicts a side perspective view of an insulated wire connected to PCB-A 120 via a pressure fitting according to one embodiment of the invention. Each insulated wire 707 pressure fits into a connector 827 residing on PCB-A 120. The connecter 827 releasably engages the insulated wire 707 around its circumference with suitable force to maintain sufficient electrical contact. Thus light engine 700 can be released from the modular LED luminaire housing 110 of a given modular LED luminaire 100 for repair or replacement, and then reattached without removing the entire modular LED luminaire 100 from an array of interconnected modular LED luminaires 100.

Figure 9:
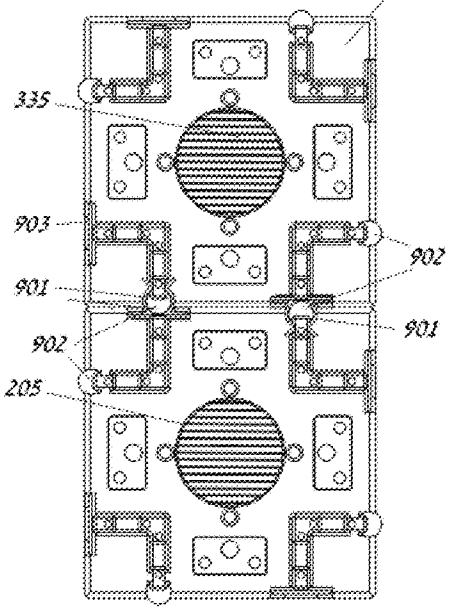
FIG. 9 depicts a top view of two (2) interconnected modular LED luminaires according to one embodiment of the invention.

FIG. 9 depicts a top view of two (2) interconnected modular LED luminaires 100 according to one embodiment of the invention. Adjacent modular LED luminaires 100 can be interconnected together to form a larger LED luminaire by removable attachment of inter-module snap clips 901 and inter-module posts 902. The modular LED luminaire housing 110 of each modular LED luminaire 100 comprises a plurality of attachment means 903 configured for attachment of inter-module snap clips 901 to modular LED luminaire housing 110.

Figure 10:
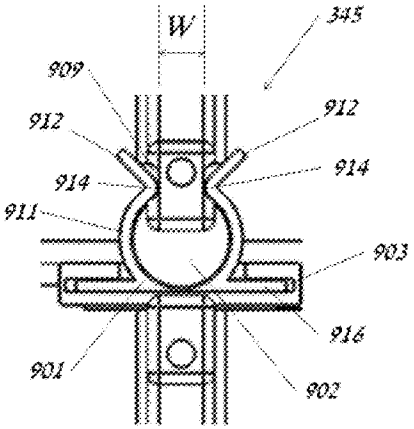
FIG. 10 depicts a bottom view of four (4) interconnected modular LED luminaires according to one embodiment of the invention.

FIG. 10 depicts a top view of an inter-module snap clip 901 suitable for interconnecting modular LED luminaires 100 according to one embodiment of the invention. As shown, inter-module snap clip 901 comprises a flexible open ring 911 terminating on each end with tabs 912 disposed at opposing angles at the each end of the open ring 911 to form a V-shaped engagement unit 914. One end of each inter-module snap clip 901 comprises a snap clip base 916 and the modular LED luminaire housing 110 comprises a slot as the attachment means 903, where the snap clip base 916 of the inter-module snap clip 901 is removably insertable into attachment means 903 of the modular LED luminaire housing 110 to attach the inter-module snap clip 901 to the modular LED luminaire 100. The inter-module posts 902 have a greater width at the end 906 proximal to the edge of the modular LED luminaire than opening W in open ring 911 of the inter-module snap clip 903. Inter-module posts 902 further comprise a recess 909 optionally disposed on opposite sides to provide additional holding tension.

To interconnect modular LED luminaires 100, inter-module snap clips 901 are inserted into attachment means 916 along the sides of the modular LED luminaire housings 110 of the modular LED luminaires 100 to be interconnected. The inserted inter-module snap clips 901 extend horizontally from the sides of the modular LED luminaire housings 110 and the open section of each ring 911 is aligned with the corresponding inter-module post 902 of an adjacent modular LED luminaire 100. Tension is created in the ring 911 as the inter-module snap clip 901 is inserted over the inter-module post 902 until the V-shaped engagement units 914 formed by the tabs 912 at each end of the ring 911 of the inter-module snap clip 901 engage with the recesses 909 in the inter-module post 902. The engagement between the inter-module post 902 and the inter-module snap clip 901 holds the adjacent modular LED luminaires 100 together. While adjacent modular LED luminaires 100 may be detached from each other by exerting sufficient force spreading the opening of ring 911 apart such that the V-shaped engagement units 914 slips out of the recesses 909 of the inter-module posts 902, such force is not encountered in ordinary operation and use of the modular LED luminaires 100 and so interconnected modular LED luminaires 100 will generally remain connected unless and until they are intentionally detached from each other.

Figure 11:
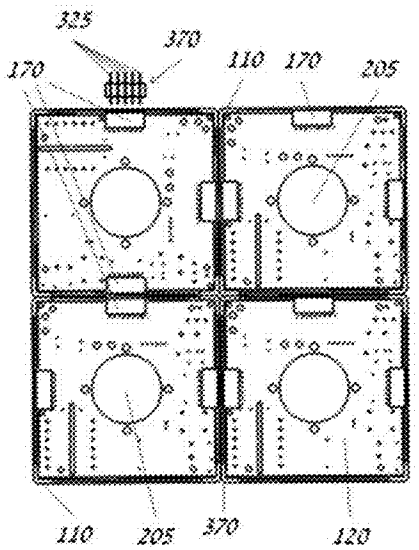
FIG. 11 depicts a top view of a snap connector suitable for interconnecting modular LED luminaires according to one embodiment of the invention.

FIG. 11 depicts a bottom view of four (4) interconnected modular LED luminaires 100 according to one embodiment of the invention. Double sided male pin connectors 370 are inserted between adjacent multi-conductor female connectors 170 that are disposed on PCB-As 120 of each modular LED luminaire 100 to provide electrical connectivity between adjacent modular LED luminaires 100. Double sided male pin connector $\mathbf{370}_1$ comprises pins $\mathbf{325}_{A\text{-}i}$ which correspond to the number of recessed holes with electrical terminals $\mathbf{315}_{A\text{-}i}$ that in turn correspond and provide electrical connectivity to PCB tracks $\mathbf{215}_{A\text{-}i}$.

In the foregoing description, the present invention has been described with reference to specific exemplary embodiments thereof. It will be apparent to those skilled in the art that a person understanding this invention may conceive of changes or other embodiments or variations, which utilize the principles of this invention without departing from the broader spirit and scope of the invention. The specification and drawings are, therefore, to be regarded in an illustrative rather than a restrictive sense.

What is claimed is:

1. An LED luminaire assembly of a plurality of modular LED luminaires, comprising a plurality of modular LED luminaires, each modular LED luminaire comprising:

a first printed circuit board, a heat sink and a second printed circuit board housed within a modular LED luminaire housing, the first printed circuit board comprising at least one programmable processor and a power supply, a plurality of PCB traces and a plurality of multi-conductor female connectors comprising a plurality of electrical terminals and plurality of recesses and the second printed circuit board comprising a plurality of light emitting diodes (LEDs) disposed thereon;

wherein the second printed circuit board is in thermal connection with the heat sink and further is in electrical connection with the first printed circuit board, wherein the LEDs are under electrical control of the processor of the first printed circuit board, a plurality of inter-module snap clips, each inter-module snap clip comprising a snap clip base and an open ring, each open ring comprising two tabs disposed at angles each open end of the ring and a V-shaped engagement mechanism formed by the angles of the two tabs, a plurality of inter-module posts attached to the modular LED luminaire housing, each inter-module post comprising a first end proximal to the side of the modular LED luminaire housing and a pair of recesses disposed at a distance further from the side of the modular LED luminaire housing than the first end, wherein the V-shaped engagement mechanisms of the inter-module snap clip are disposed in the recesses of the inter-module post.

2. The LED luminaire assembly of claim 1 wherein the second printed circuit board is in electrical communication with the first printed circuit board by way of a plurality of insulated wires that pass through cavities in the heat sink.

3. The LED luminaire assembly of claim 1 wherein an optical array resides on top of the LEDs on each modular LED luminaire.

4. The LED luminaire assembly of claim 1, wherein the spacing between LEDs is equivalent in both the X and Y axis.

5. The LED luminaire assembly of claim 4, wherein the spacing between LEDs of adjacent modular LED luminaires is equivalent to the spacing of the LEDs on a single modular LED luminaire.

6. The LED luminaire assembly of claim 1, further comprising a metallic plate mounted around the perimeter of the LED luminaire assembly, wherein the metallic plate is in thermal connection with the heat sink, wherein further the metallic plate is constructed of a material suitable for thermal convection of heat from the heat sink to the exterior of the LED luminaire assembly.

7. The LED luminaire assembly of claim 1, further comprising an internal fan disposed in the interior of the modular LED luminaire housing, wherein the internal fan circulates air which facilitates air circulated cooling of critical electrical components residing on the first and second printed circuit boards.

8. The LED luminaire assembly of claim 1, further comprising a controller of the LED drive current, comprising:

an isolation device disposed on the secondary low voltage side of the power supply; and a low pass filter, wherein the isolation device transfers the primary side pulse width modulated signal generated by the programmable processor across the isolation barrier to the primary side of the first printed circuit board, wherein the primary side pulse width modulated signal is passed through the low pass filter which converts the pulse width modulated signal into an analog equivalent signal, wherein the analog equivalent signal is input to the regulation circuit of the primary side of the first printed circuit board for controlling the LED drive current.

9. An LED luminaire assembly of a plurality of modular LED luminaires, comprising a plurality of modular LED luminaires, each modular LED luminaire comprising:

a first printed circuit board, a heat sink and a second printed circuit board housed within a modular LED luminaire housing, the first printed circuit board comprising at least one programmable processor and a power supply, a plurality of PCB traces and a plurality of multi-conductor female connectors comprising a plurality of electrical terminals and plurality of recesses, where each PCB trace is in communication with at least one electrical terminal and each recess provides access to a unique electrical terminal, wherein further the electrical terminals comprise a center terminal and a plurality of symmetric peripheral terminals and the second printed circuit board comprising a plurality of light emitting diodes (LEDs) disposed thereon;

wherein the second printed circuit board is in thermal connection with the heat sink and further is in electrical connection with the first printed circuit board, wherein the LEDs are under electrical control of the processor of the first printed circuit board, wherein the central terminal of the multi-conductor female connector is in communication with a first unique PCB trace on the first printed circuit board, wherein the two terminals adjacent to the central terminal are both in communication with a second unique PCB trace, wherein the two terminals disposed second from the central terminal are both in communication with the third unique PCB trace, a plurality of inter-module snap clips, each inter-module snap clip comprising a snap clip base and an open ring, each open ring comprising two tabs disposed at angles each open end of the ring and a V-shaped engagement mechanism formed by the angles of the two tabs, a plurality of inter-module posts attached to the modular LED luminaire housing, each inter-module post comprising a first end proximal to the side of the modular LED luminaire housing and a pair of recesses disposed at a distance further from the side of the modular LED luminaire housing than the first end, a plurality of male connectors having pins corresponding to the number of electrical terminals and recesses of the multi-conductor female connectors, wherein the pins of the male connectors mate with the recesses of the multi-conductor female connectors, causing connection between the electrical terminals of adjacent multi-conductor female connectors, wherein the first printed circuit boards of adjacent modular LED luminaires are in electrical connection by way of the connections between the electrical terminals of adjacent multi-conductor female connectors, wherein the V-shaped engagement mechanisms of the inter-module snap clip are disposed in the recesses of the inter-module post.

10. The modular LED luminaire of claim 9 wherein the second printed circuit board is in electrical communication with the first printed circuit board by way of a plurality of insulated wires that pass through cavities in the heat sink.

11. The modular LED luminaire of claim 9 wherein an optical array resides on top of the LEDs.

12. The modular LED luminaire of claim 11, wherein the spacing between LEDs is equivalent in both the X and Y axis.

13. The LED luminaire assembly of claim 9, further comprising a metallic plate mounted around the perimeter of the LED luminaire assembly, wherein the metallic plate is in thermal connection with the heat sink, wherein further the metallic plate is constructed of a material suitable for thermal convection of heat from the heat sink to the exterior of the LED luminaire assembly.

14. The LED luminaire assembly of claim 9, further comprising an internal fan disposed in the interior of the modular LED luminaire housing, wherein the internal fan circulates air which facilitates air circulated cooling of critical electrical components residing on the first and second printed circuit boards.

15. The LED luminaire assembly of claim 9, further comprising a controller of the LED drive current, comprising:

an isolation device disposed on the secondary low voltage side of the power supply; and a low pass filter, wherein the isolation device transfers the primary side pulse width modulated signal generated by the programmable processor across the isolation barrier to the primary side of the first printed circuit board, wherein the primary side pulse width modulated signal is passed through the low pass filter which converts the pulse width modulated signal into an analog equivalent signal, wherein the analog equivalent signal is input to the regulation circuit of the primary side of the first printed circuit board for controlling the LED drive current.

* * * * *